US006618328B1

(12) United States Patent
Ellner et al.

(10) Patent No.: US 6,618,328 B1
(45) Date of Patent: Sep. 9, 2003

(54) WATCH

(75) Inventors: Brenda Ellner, Shaker Heights, OH (US); Paulette Nance, Moreland Hills, OH (US)

(73) Assignee: HourPower, L.L.C., Shaker Heights, OH (US)

( * ) Notice: Subject to any disclaimer, the term of this patent is extended or adjusted under 35 U.S.C. 154(b) by 0 days.

(21) Appl. No.: 09/630,056

(22) Filed: Aug. 1, 2000

Related U.S. Application Data

(60) Provisional application No. 60/180,543, filed on Feb. 7, 2000.

(51) Int. Cl.[7] ..... G04B 37/00; G04C 23/02; A44C 5/00

(52) U.S. Cl. ..... 368/88; 368/278; 368/281

(58) Field of Search ..... 368/10, 88, 276, 368/278, 281, 282, 283

(56) References Cited

U.S. PATENT DOCUMENTS

| | | | | |
|---|---|---|---|---|
| 1,165,262 A | | 12/1915 | Jolly | |
| 2,219,277 A | | 10/1940 | Kaufmann | |
| 2,235,095 A | * | 3/1941 | Barthman | |
| 3,722,206 A | * | 3/1973 | Bergey | 58/50 |
| 3,864,905 A | * | 2/1975 | Richardson | 58/50 |
| 4,444,513 A | | 4/1984 | Prollochs et al. | |
| D285,417 S | | 9/1986 | Nakane | |
| D303,503 S | | 9/1989 | Kai | |
| 4,903,250 A | | 2/1990 | Cho | |
| 5,138,590 A | * | 8/1992 | Masuda et al. | 368/10 |
| D339,299 S | | 9/1993 | Kawashima | |
| D352,469 S | * | 11/1994 | Schlup | D10/39 |
| D353,778 S | | 12/1994 | Hanagata | |
| 5,384,756 A | | 1/1995 | Pelosi | |
| D380,393 S | | 7/1997 | Molas | |
| 5,657,298 A | | 8/1997 | Choay | |
| 5,663,932 A | | 9/1997 | Weng | |
| D391,872 S | | 3/1998 | Sugarman et al. | |

* cited by examiner

*Primary Examiner*—Vit Miska
(74) *Attorney, Agent, or Firm*—D. Peter Hochberg; Katherine R. Vieyra; Sean Mellino

(57) ABSTRACT

A timekeeping apparatus having a hidden compartment. The compartment can contain permanent or removable psychological message and/or printed messages. The messages can be printed messages, digital messages, recordable audio messages and aromatic messages. The compartment can also contain such items as a mood sensing stone which changes color according to the wearer's mood, magnets or crystals.

1 Claim, 8 Drawing Sheets

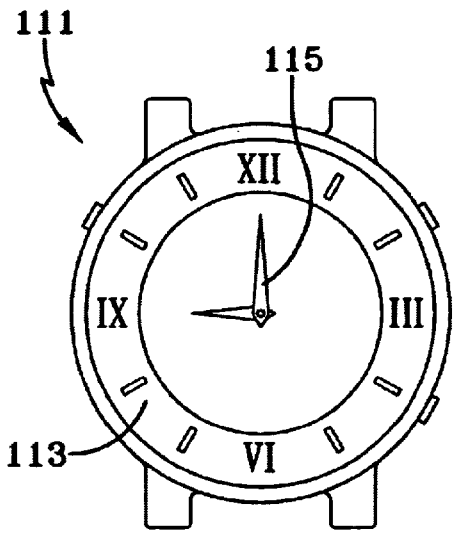
FIG-18
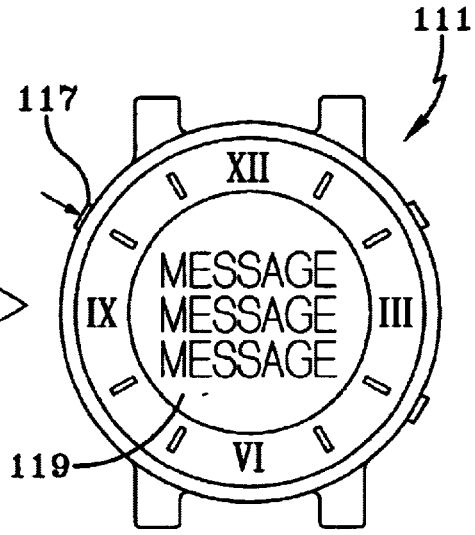
FIG-19
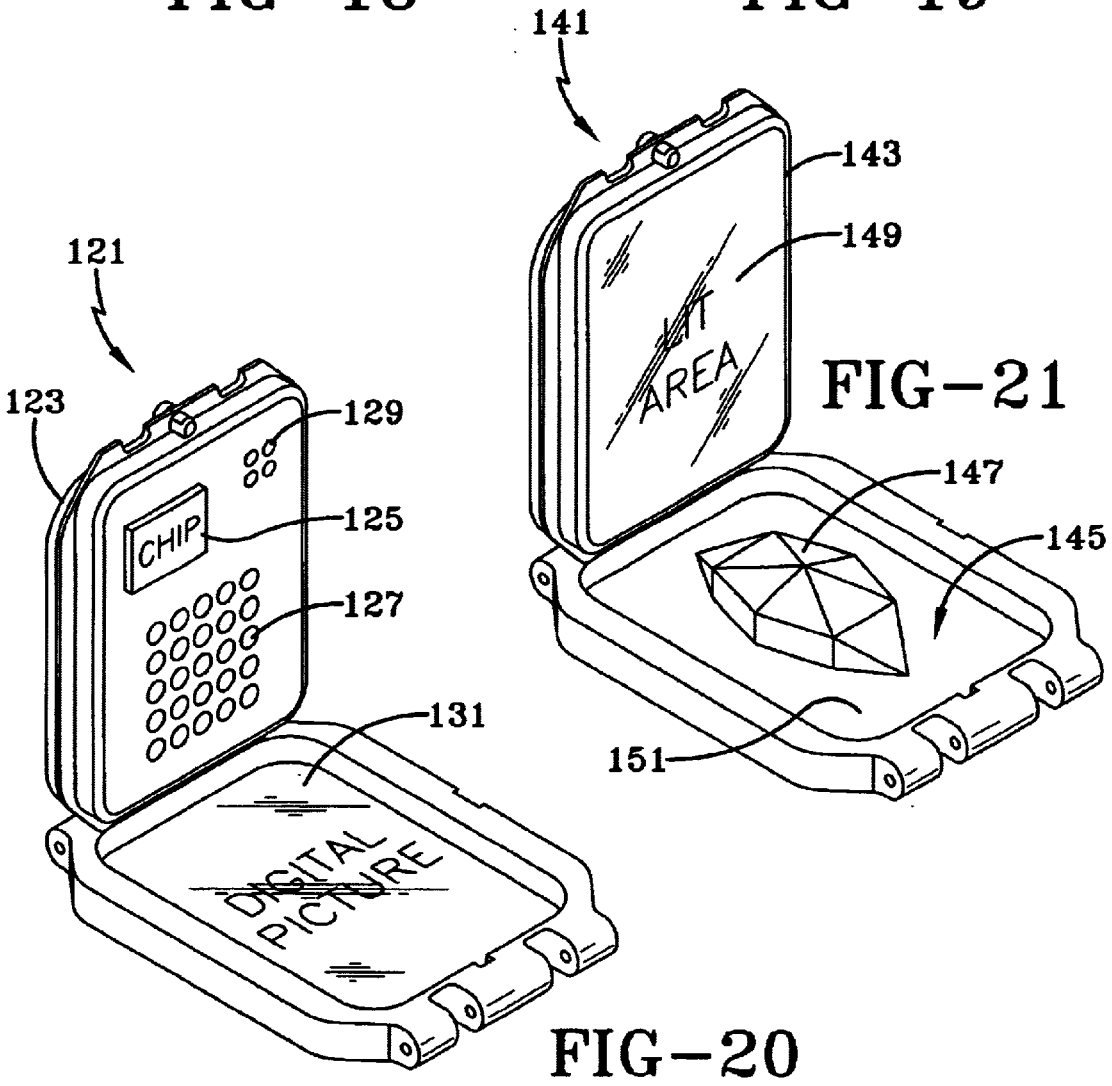
FIG-21
FIG-20

WATCH

CROSS-REFERENCE TO RELATED APPLICATION

This application claims the benefit of U.S. Provisional Application No. 60/180,543 filed Feb. 7, 2000.

BACKGROUND OF THE INVENTION

1. Field of the Invention

The present invention relates to clocks, timepieces and watches, particularly but not limited to wristwatches having a watch face which is liftable off of a watch back or backing, the watch back having an outwardly facing member for performing a useful function.

2. Description of the Prior Art

There are many different watches which are on the market or known displaying information other than the time which is shown on the watch face Such other information includes the date, time lapsed for a period being measured, telephone numbers, a computer output, etc. Many watches perform functions other than indicating the time of day. These include access to data bases in the circuitry of electronic watches such as an electronic directory for telephone numbers, a computer for performing mathematical computations, and the like.

Watches are also known where the watch face is movable. There are "flip-over" watches in which the watch face if lifted off the watch back, and flipped over to reveal some artistic message or the like on the back of the watch face. It is well known to place an inscription on the back of a watch backing (the part of the watch that touches the wrist).

There are many watches having moveable accessories for moving the watch face, for covering the watch face, and for revealing another working component associated with a watch. U.S. Pat. No. Des.285,417 (Nakane) shows a wristwatch which can be removed from a backing on the band, and be replaced with a toy aircraft. U.S. Pat. No. Des.303,503 discloses a wristwatch with a calculator, the calculator having a hinged cover. Disclosed in U.S. Pat. No. Des.339,299 is a wrist band holding a wristwatch, a calculator and a telephone index, these being hinged one on top of the other and accessible for their respective use. In another design patent, U.S. Pat. No. Des.380,293, a wristwatch is hinged to provide the cover for a receptacle between the watch backing and the back side of the watch face. A similar device is shown in U.S. Pat. No. Des.391,872.

There are a number of patents showing watches having moveable parts, other than the workings of the watch itself. In U.S. Pat. No. 1,165,262, a watchband has adjustable spring prongs for holding different sizes of watches. A mounting for a watchcase is shown in U.S. Pat. No. 2,219,277, where a watch face can be removably held in a watchband having a backing for the watch. A hinged arrangement is shown in U.S. Pat. No. 4,444,513, where a watch face can be rotated to reveal a different watch. One watch can be analog, and the other digital. U.S. Pat. No. 4,903,250 describes a watch having a memo case disposed adjacent the watch. A display face is fixed, and the memo portion is next to it. The memo portion can be replaced with printed cards. Thus, the watch backing is really receptacle for the printed cards.

U.S. Pat. No. 5,384,756 discloses a combined identification device and wristwatch. The watch face is hinged over a platform holding a microfilm with the wearer's medical information. If the watch face is lifted up, panels, which are biased upwardly, reveal the microfilm. The microfilm is carried in one of the panels, and another panel has a lens for focusing on the microfilm. The watch backing itself is only, in effect, a receptacle for holding the folded panels.

A modular watch having interchangeable elements is shown in U. S. Pat. No. 5,657,298. A rescue watch is described in U.S. Pat. No. 5,663,932 where the watch assembly has a container chamber holding pressurized liquid or gas to provide air for inflating a device, or for spraying an assaulter when the rescue watch is used for self defense. Some of the watches described above are flip-over watches. Another flip-over watch which is currently on the market is called the Basculante watch. However, neither this watch nor the others described above, carry any member on the backing of the watch, that is the plate upon which the watch normally sits, for performing a useful function.

SUMMARY OF THE INVENTION

It is an object of the present invention to provide a functional member in connection with a wristwatch, where the device is not readily apparent to others but which can be accessed by the wearer of the watch as desired.

Another object is to provide a wristwatch with a backing holding a function and therapeutic member.

It is another object of the present invention to provide a wristwatch having a message which can be viewed at the discretion of the wearer, but is generally not observable by others.

It is another object of the present invention to provide various types of messages on the backing of a watch. Such messages could be in writing, artistic messages, scents, musical messages, or other visual or auditory messages.

Another object of the present invention is to provide on or associated with the backing of a watch, a removable and/or exchangeable functional and/or therapeutic member.

Another object of the invention is to provide a watch for transmitting a signal to a remote place.

A further object is to provide a watch with a secret or hidden compartment.

Yet another object is to provide a watch with a hidden compartment having messages, such as written messages, artistic messages, scents, musical messages, visual messages, therapeutic messages or auditory messages, or to contain items such as magnets, pictures, natural or synthetic stones or the like.

It is still a further object of the present invention to provide a wristwatch having a backing with a functional member for generating signals to help find the wristwatch itself or the wearer of the wristwatch if they are lost or otherwise cannot be found. This would be useful at night, under avalanches, in the water, etc.

It is yet a further object of the present invention to provide means for lifting a watch face from a watch backing to render a functional and therapeutic member on the watch backing accessible and useable.

The foregoing and other objects of the invention are achieved by means of a wristwatch having a back or backing upon which the watch face (which includes the watch workings) is entirely or partially removable to render a useful device on the watch backing accessible for use. The useful device can be messages which can be permanent, removable, or exchangeable, and could be directly on the watch backing itself or on an appropriate disc for holding the message. The message can be a psychological, therapeutic message as discussed below, olfactory messages generating a particular type of aroma, auditory messages such as those produced by particular electronic chips, certain crystals or stones, pictures and the like. A person wearing a wristwatch of the foregoing type can gain access to the functional and/or therapeutic member easily and often without the observation of others, to obtain the desired purpose of the member. The watch can have a hidden or secret compartment for containing a variety of messages or for holding a variety of things. The face of the watch can have many shapes, and could be round, square, oval, rectangular, etc.

The invention further involves a functional member mounted on the backing of a watch which can be relayed to a remote place. This would include means for generating a signal such as a visual, auditory, olfactory or electronic signal. Such signals could be observed or otherwise recognized by the wearer of the watch, or else could be useful to third parties and the remote place.

BRIEF DESCRIPTION OF THE DRAWINGS

FIGS. 18 and 19 show still another embodiment of the invention with a means for revealing a push-button means for revealing a message on the backing of a watch according to the invention.

FIG. 20 shows another embodiment of the invention where a digital picture is held on the backing of the watch.

FIG. 21 shows another embodiment of the invention having a watch face which is hinged to be removed from the watch backing, and a functional member is on the back of the watch. The back of the watch or the backing can be illuminated.

DESCRIPTION OF THE PREFERRED EMBODIMENTS

The invention involves a watch having a hidden compartment located between the backing of the watch and the face of the watch, the hidden compartment having a variety of functions. The hidden compartment can hold a message generating item. The message can be a printed psychological message. The messages can be beneficial to the wearer of a watch. Psychological studies have shown that when a person continually provides positive and informative statements to themselves throughout the day, those persons actually unleash energy to provide for change. These studies show outcomes as varied as increased concentration, athletic ability, business achievements, and well-being. When these persons spend time in this positive way, it actually reduces the distractions of daily life which interfere with brain activity. At the sane time, it raises a person's level of consciousness around a desired goal. This, in turn, provides a real pathway to accomplish what these persons want. It also provides a way to increase one's feelings of power, thereby, working more intensively and efficiently.

The watch according to some embodiments of the present invention helps people realize their own inner resources and command change.

Most people are very concerned about the time of day throughout the day as well as the amount of time it takes to do various things in the course of a day. A watch is therefore a very important part of the items which people use. A watch according to some embodiments of the present invention provides a message area on the watch backing which can be hidden from others in a secret compartment, which holds a message such as a psychological message. Whenever a person wants to check the time, or even without checking the time, the person can effect movement of the watch face from the watch backing to view the message and obtain its psychological benefit. The message can be an inner statement which the person can look at and repeat. This message, when viewed, can constantly reinforce its benefit as the message is viewed and repeated. In another embodiment, a mood sensing stone is provided on the watch for contacting with the user's skin. The stone changes color according to the user's mood which the user then can focus on changing.

Figure 1:
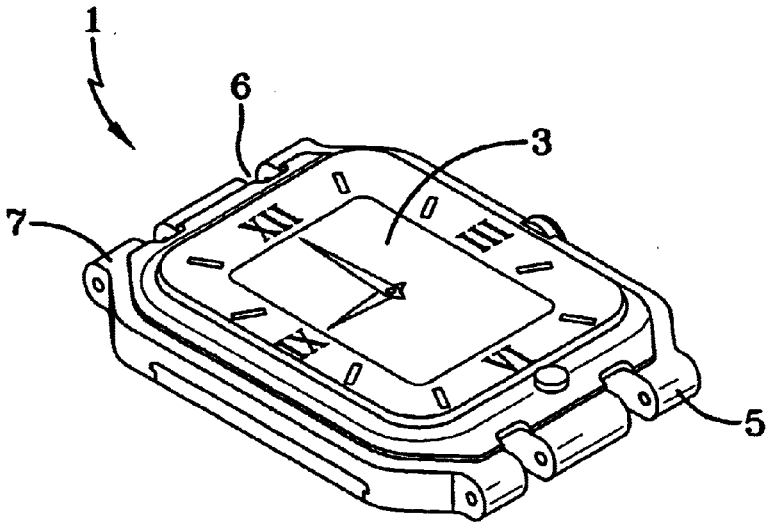
FIGS. 1 and 2 are perspective views of one embodiment of the invention showing a watch face in its closed and open positions, respectively.

Turning first to FIG. 1, which shows an embodiment of the invention in its closed, and ordinary position. FIG. 1 shows a watch assembly 1 having a watch face 3 with a first end 5 and second end 6 configured to receive a watch band. Watch assembly 1 further has a hinge 7 at the second end 6. Watch assembly 1 is shown in the closed position.

Figure 2:
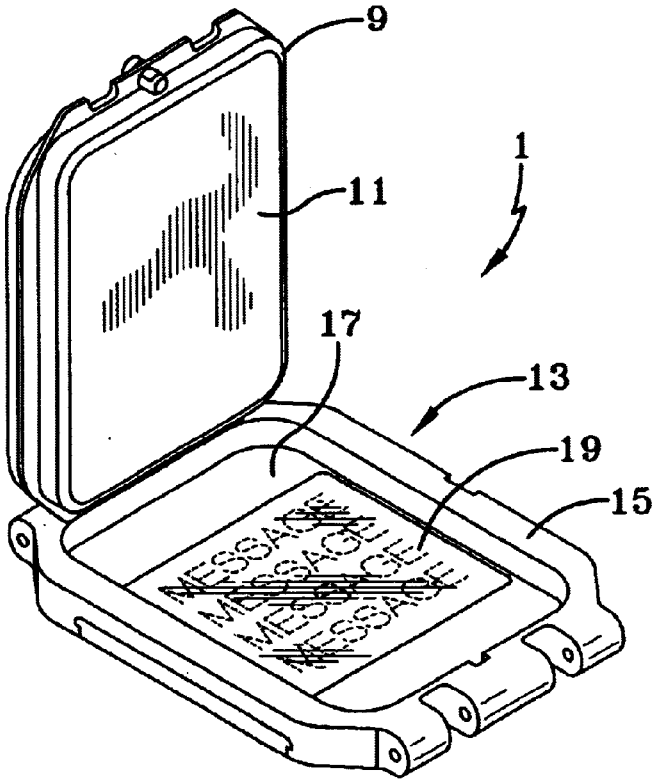

Turning next to FIG. 2, watch assembly 1 is again shown with its timepiece 9 rotated about hinge 7 to its open position. Watch assembly 1 has a rear face 11. Watch assembly 1 has a backing 13 which includes a recess 17. Recess 17 can be a secret compartment, and is bordered by a sidewall 15. A portion of the bottom surface of recess 17 serves as a message bearing area 19. Advantageously, the message can be a psychological message as described above. The message can be in any form, either by means of words, pictures, or, as described later, other means as well. The message can be permanent, or can be removable, or be replaceable with a different message.

Figure 3:
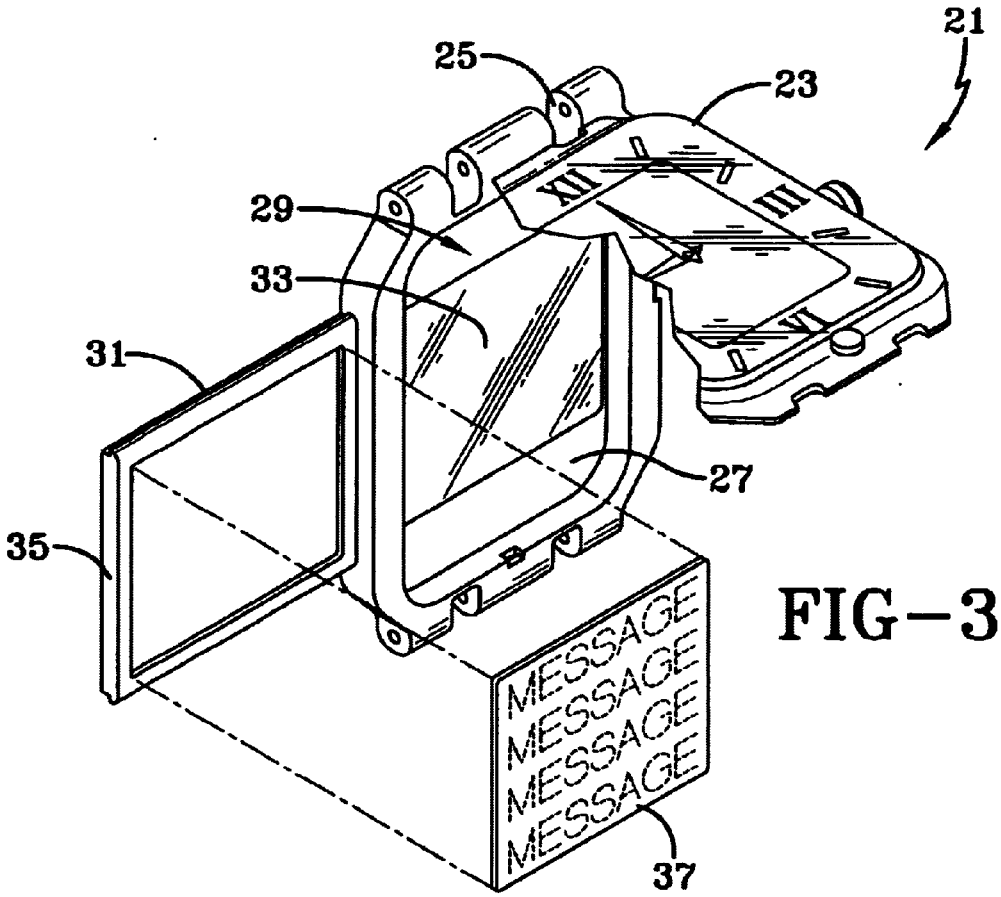
FIGS. 3 and 4 are perspective views of another embodiment of the invention showing the watch face in its raised position in a message bearing frame having a message about to be placed in the frame, and the frame being moveable onto the watch backing, respectively.
Figure 4:
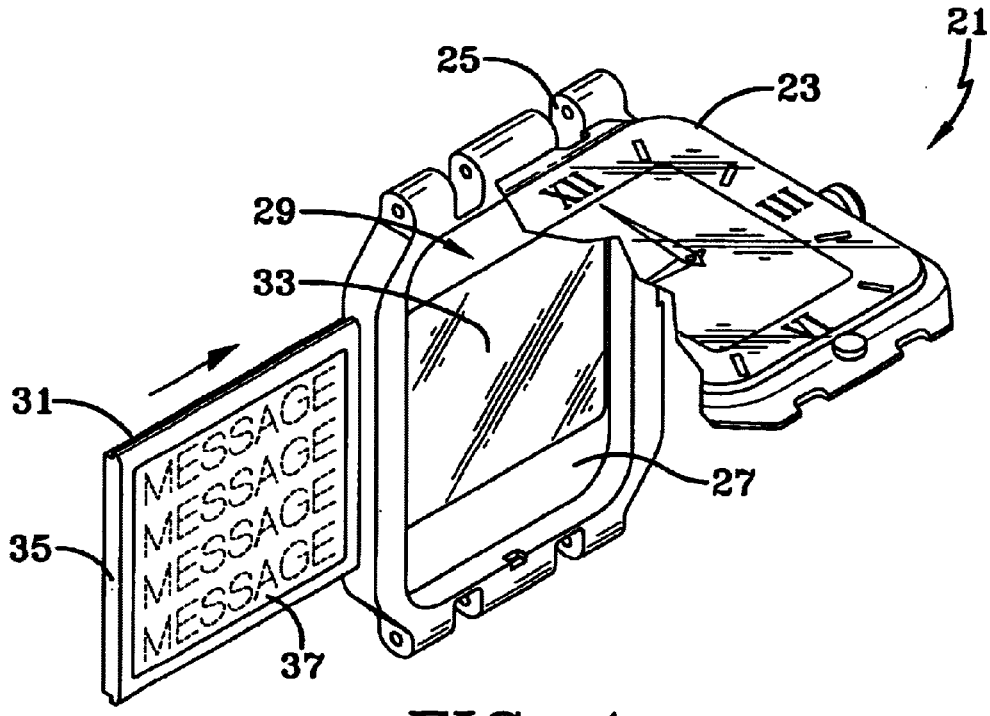
Figure 6:
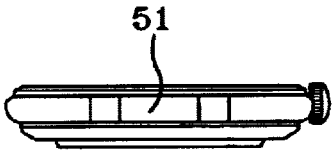
FIGS. 5, 6, 8 and 9 show all four sides of the watch shown in FIG. 7.
Figure 5:
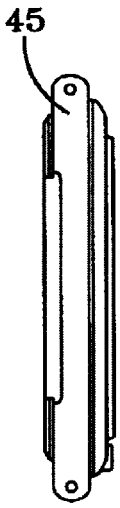
Figure 7:
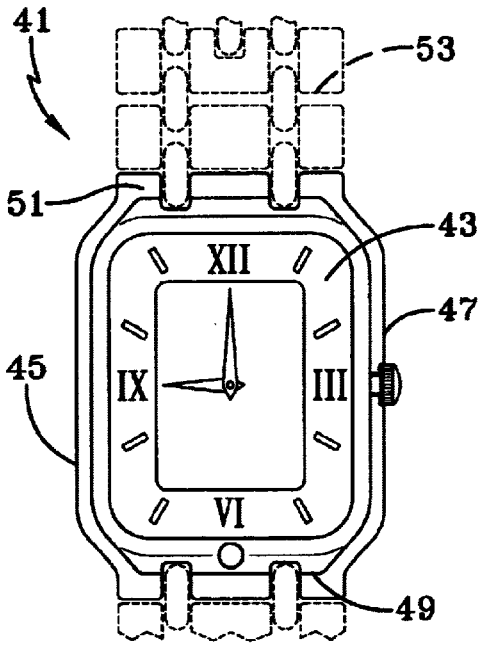
FIG. 7 is a front view of the embodiment shown in FIGS. 3 and 4.
Figure 9:
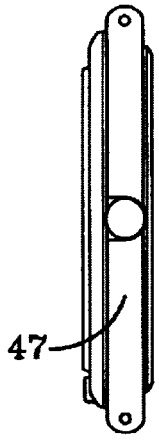
Figure 8:
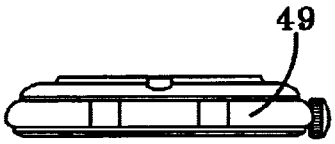

Referring next to FIGS. 3 and 4, another watch assembly 21 is shown. Watch assembly 21 includes a timepiece 23 which is shown pivoted to its open position about a partially shown hinge 25. Watch assembly 21 includes a recess or secret compartment 27 in backing 29. A moveable frame 31, when in its installed position, overlies an area 33 in recess 27. Frame 31 includes frame walls 35 in which a sheet, plate or other message bearing member 37 can be inserted. FIG. 3 shows member 37 before it is installed in frame 31, and FIG. 4 shows frame 31 with message-bearing member 37 installed and being moved into backing 29. Frame 31 can be moved so that it overlies backing 29, and is then inserted into recess 27 of backing 29. The dimensions of recess 27 and frame 31 should be such that the frame is held tightly in a semi-interference type fit, but preferably so that it can be released without difficulty in order to change member 37. Alternatively, a slot can be formed in the sidewall of base 29 so that frame 31 can be slid into recess 27 of backing 29.

Timepiece 21 is preferably held in its closed position by a releasable latch, and a button or other release mechanism releases the latch. A spring or other biasing means can bias the timepiece to its open position. FIGS. 5–9 show an embodiment of the invention which can be the same as that shown in FIGS. 3 and 4, or can be a modification thereof These figures show that a watch assembly according to the invention can look like an ordinary watch, be it round, oval, square, rectangular (as shown), or other symmetrical or irregular shapes, which does not reveal that it has a backing with a secret compartment for holding a message or other functional member. These figures show a timing apparatus 41 having a watch face 43 which is held in a casing having left side wall 45, right side wall 47, first wall 49 and, opposite second wall 51. A watch band 53 is connected by an appropriate mechanism at walls 49 and 51. Walls 45, 47, 49 and 51 form on their inside portion, the walls of the backing which holds a functional member.

Figure 10:
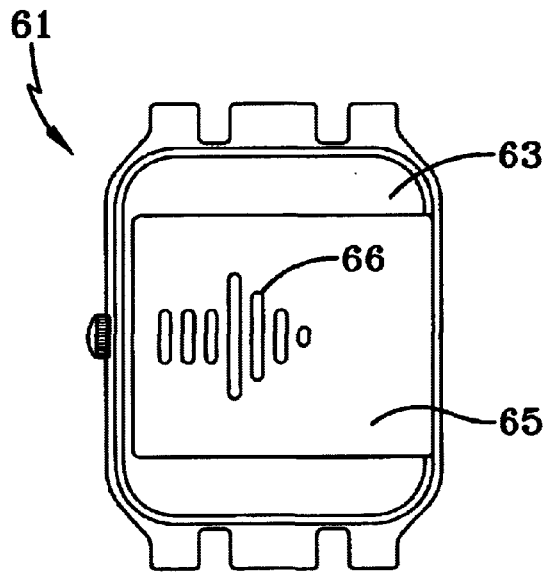
FIG. 10 is a back view of another embodiment of the invention, showing a slidable frame for holding a message.
Figure 11:
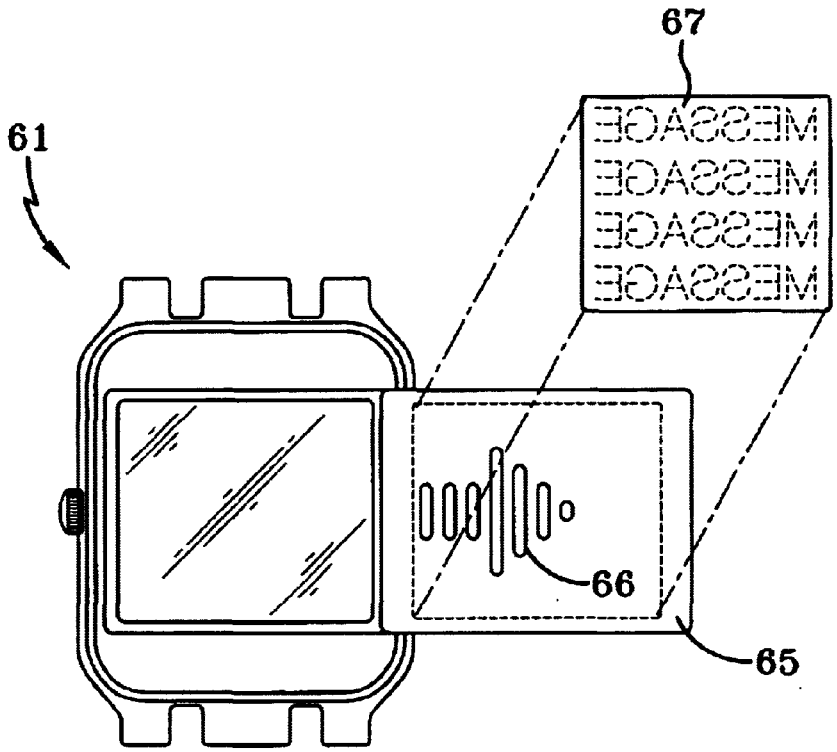
FIG. 11 shows the manner in which the message is inserted into the frame.

Another embodiment of the invention is shown in FIGS. 10 and 11. A watch assembly 61 has a backing 63 on which a timepiece is mounted. Backing 63 can be configured to receive a watch band at both ends. The view shown could also be the front of watch assembly 61. Watch assembly 61 has a removable panel 65 which is slidable from the closed position shown in FIG. 10, to an open position shown in FIG. 11. The direction of movement of panel 65 is indicated by the arrow 66. Panel 65 holds a removable message having a display and can be some sort of plaque, and can be made from plastic or metal. Panel 65 can be moved from the closed position to the open position so that a plaque 67 can be selectively added or removed for viewing, or replaced by a different plaque. The plaques bear the types of messages discussed earlier.

Figure 12:
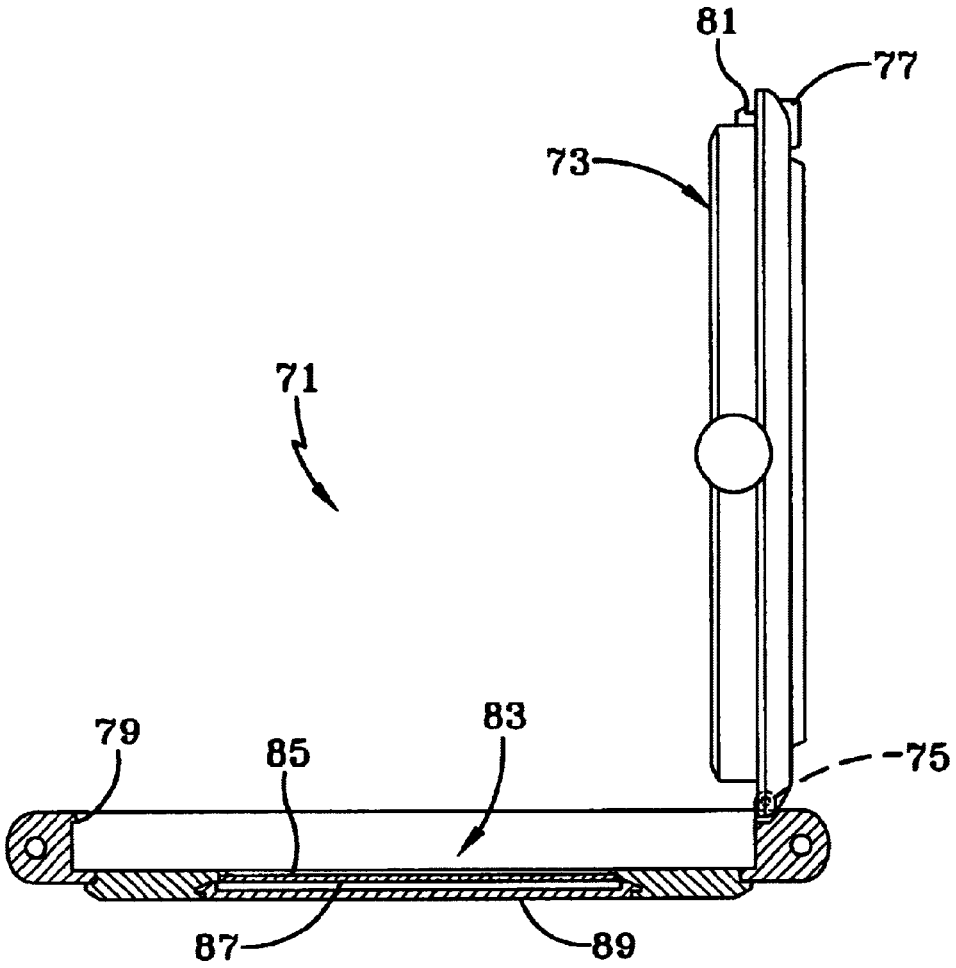
FIGS. 12 and 13 are partially cross-sectional views of an-embodiment of the invention showing the watch face in its open and closed positions, respectively.
Figure 13:
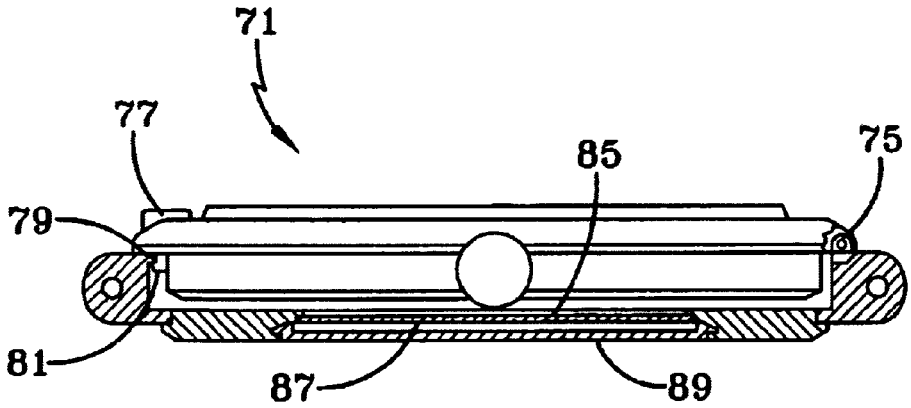

A more detailed view of a hinged watch according to the invention is shown in FIGS. 12 and 13. A watch assembly 71 has a timepiece 73 with which is pivotable about a hinge 75 and held in place in the closed position shown in FIG. 13 by means of a latch assembly composed of a manually operable latch release 77 which cooperates with a locking tooth 79. When timepiece 73 is pivoted about hinge 75 from the open position shown in FIG. 12, to the closed position shown in FIG. 13, a finger 81 connected to latch release 77 engages locking tooth 79 to releasably hold the latch in its locked position. When latch release 77 is depressed, or slid to one side according to the details of the latch assembly, timepiece 73 can be moved to the open position. A spring can be provided to bias time piece 73 to its open position.

Watch assembly 71 has a message assembly 83 which includes a glass panel 85, a message or secret compartment 87 for holding the plaque with the message and a rear push door 89. In order to install a message, rear push door is opened or removed, and a message plaque is inserted against panel 85. The message is placed so that it can be viewed from above, that is from the direction from timepiece 73. Door 89 is then closed or replaced and watch assembly 71 is ready for use. Secret compartments can be located above door 89 or beneath timepiece 73 as shown in the drawings.

Figure 14:
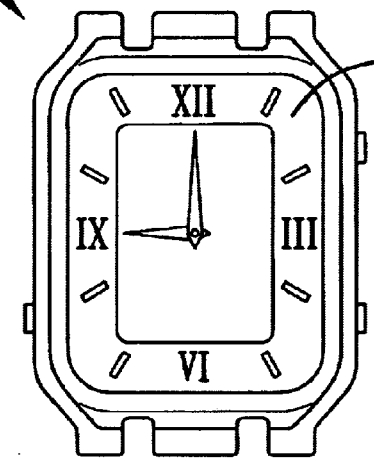
FIGS. 14 and 15 show another embodiment of the invention with a means for revealing a message across the backing of the watch.
Figure 15:
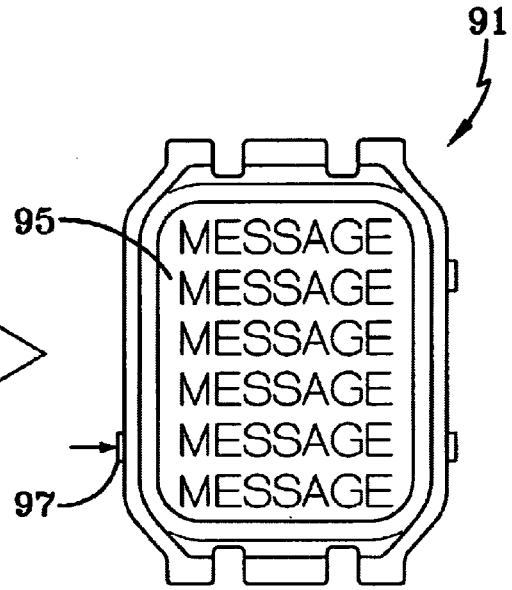

A further embodiment of the invention is shown in FIGS. 14 and 15. A watch assembly 91 is shown. FIG. 14 shows a timepiece 93 installed over and extending into base 95. Timepiece 93 is releasably locked in backing 95. A latch release 97 can be depressed or actuated in some other way, to release timepiece 93 from its locked position. Timepiece 93 is then removed from backing 95 and the message located in backing 95 becomes visible. The compartment between timepiece 93 and backing 95 can be a secret compartment.

Figure 16:
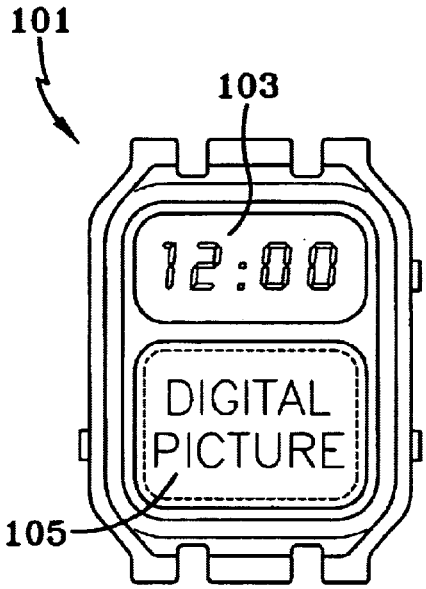
FIGS. 16 and 17 show a variation of the embodiment shown in FIGS. 14 and 15.
Figure 17:
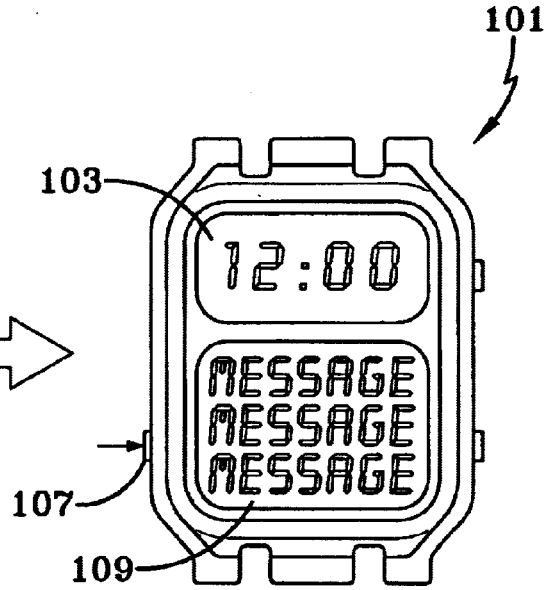

A variation on the foregoing embodiment is shown in FIGS. 16 and 17. In this case, a watch assembly 101 includes a digital display piece 103 and another viewable item located beneath it such as a digital picture 105 shown in FIG. 16. However, upon the depression or other actuation of a release member 107, the digital picture 105 is replaced by a psychological message 109. Digital picture 105 can be an electronic image and by actuating member 107, that image is replaced by the message 109.

Another embodiment of the invention is shown in FIGS. 18 and 19. FIG. 18 shows a watch assembly 111 with a watch face 113 around the periphery of the front portion of watch assembly, with hands 115 operating in the normal mode. No message is visible. However, upon the depression of an actuating member 117, watch face 113 changes to an auxiliary mode, wherein a message is revealed inside of watch face 113. This message is not observable until member 117 is actuated as shown in FIG. 19. The message is indicated at numeral 119.

Yet another embodiment of the invention is shown in FIG. 20. In this case, a watch assembly 121 includes a timepiece 123 which includes on its rear portion and extending into or facing a secret compartment, an electronic voice chip 125 with a speaker 127. Upon the operation of an actuating member, an audible message can be heard through speaker 127. A microphone assembly 129 can be provided in which the user can put his or her own message in the timepiece, and it can be listened to, and changed, as desired. A digital picture or some message can be provided in backing 131 and in the secret compartment. Alternatively, or in addition, other messages besides audio messages can be included in timepiece 123. For example, an aroma generator unit for generating an aroma "message" can be provided for the user.

Alternatively, all of the foregoing items included in timepiece 123, can be included in backing 131, as explained earlier. In this case, timepiece 123 would be a cover for the messages and means for emitting the messages, in backing 131.

FIG. 21 shows another embodiment of the invention. In this embodiment, a watch assembly 141 is shown having a timepiece 143 which is hinged on a wall of backing 145. Backing 145 has a functional member 147 which is shown in schematic form, located in a secret compartment beneath the timepiece when the latter is in a closed condition. Functional member 147 can show a visual message, can emit an audible message, can emit an aroma message, can be an artistic and/or symbolic device which can be viewed for the therapeutic comfort or other beneficial advantage to the user, can emit signals (electronic, audio, visual, etc.) to indicate the whereabouts of the watch assembly or of the wearer of the watch assembly etc. In some instances, the back of timepiece 143 can be illuminated as indicated by the term "lit area" 149. Another lit area can be provided in base 145 as indicated by the numeral 151.

Figure 22:
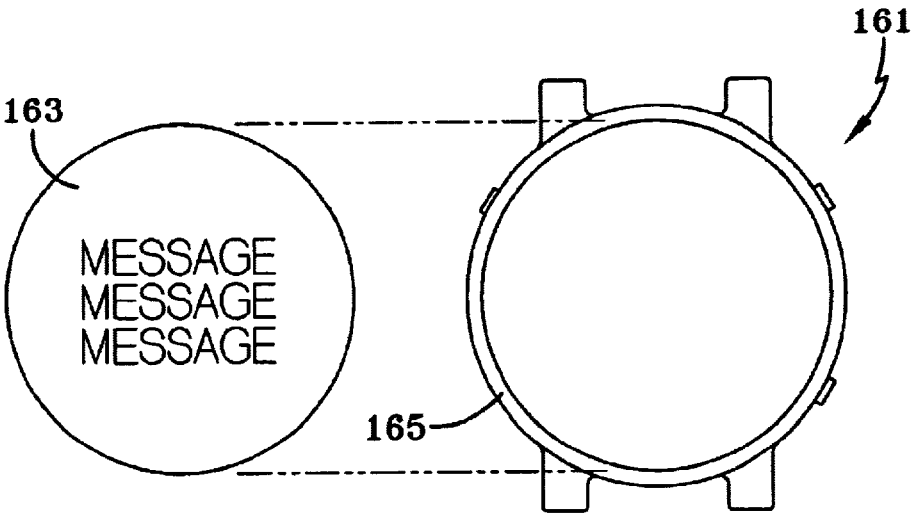
FIG. 22 shows a round watch according to another embodiment of the invention where a message bearing unit is inserted as the watch backing or as part of the watch backing.

FIG. 22 shows a watch assembly 161 viewed from its rear direction. A removable plaque 163 bearing a message is shown removed from the rear of the watch, and can compose the base of the backing of the watch with the message shown on it. It could also be a plaque which is held in place by a removable back wall of the watch. As shown, it can be pushed to place it in its proper position, and can be changed easily. Plaque 163, if forming the base of the watch assembly, is dimensioned so that it is tightly held within the circular walls 165 of watch assembly 161. Other locking means such as a screw type arrangement, or the like can be used as well. A secret compartment can exist between the base and the forward part of the backing.

Figure 23:
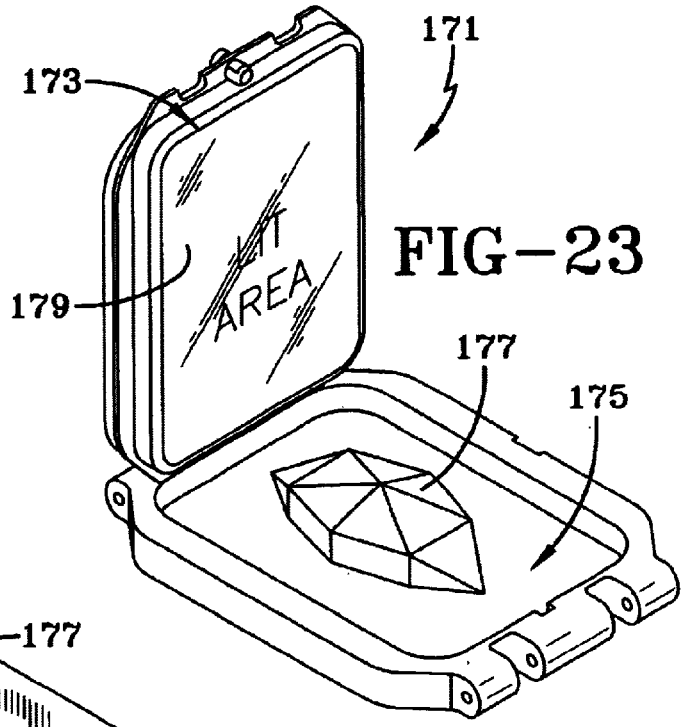
FIG. 23 shows another embodiment of the invention having a stone embedded in the backing of the watch.
Figure 24:
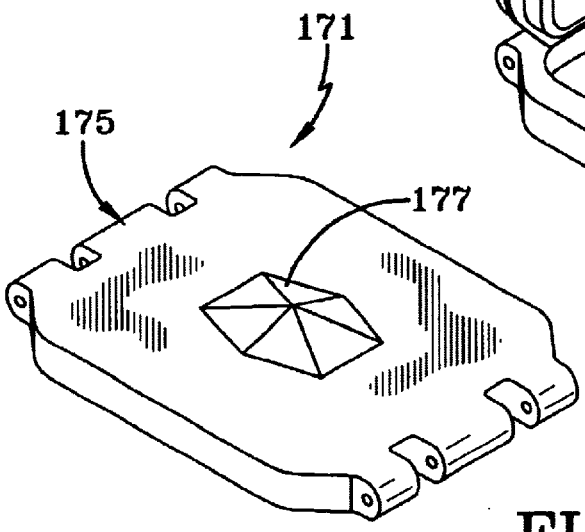
FIG. 24 shows an elevated rear perspective view of the embodiment of the invention shown in FIG. 23 showing the embedded stone protruding through the rear surface of the backing so that when the watch is worn a portion of the stone contacts the wearer's wrist.

Another embodiment is shown in FIGS. 23 and 24. In this embodiment, a watch assembly 171 is shown having a timepiece 173 which is hinged on a wall of backing 175. Backing 175 has a mood sensing stone 177 embedded in the center and located in a secret compartment. The rear of stone 177 protrudes through the bottom of backing 175 such that a portion of stone 177 is pressed against the wearer's skin. Stone 177 will change color according to the emotional state of the user, i.e., calm, angry, sad, irrational, etc. The wearer can check their emotional state by viewing stone 177 by flipping the timepiece 173 upward away from backing 175. The wearer can then alter their behavior if necessary to return to a more normal state of mind. The back of timepiece 173 can be illuminated as indicated by the term "lit area" 179.

The foregoing embodiments could also be used for clocks. For example, a free standing clock having a hinged or otherwise moveable clock section can be opened from a closed position to yield a clock back having the message bearing plaques or other functional member. The concept could also be employed in other such horological instruments such as lockets, pendants, rings, etc.

The invention has been described in detail, with particular emphasis being placed on the preferred embodiments thereof, but variations and modifications may occur to those skilled in the art to which the invention pertains.

What is claimed is:

1. A watch assembly for being attached to a watch band for extending around a wrist, the watch assembly having opposing ends for attachment to the band and opposing sides generally parallel to the side edges of the band, said watch assembly comprising:

a backing having end portions for attachment to a watch band, the backing having a timepiece supporting base and an opening extending through said timepiece supporting having a first part of a timepiece hinge apparatus on one of said end portions and a first part of a locking device on the other of said end portions;

a timepiece pivotally mounted on said hacking, said timepiece having a second part of the timepiece hinge apparatus for cooperating with the first part of the timepiece hinge apparatus for enabling said timepiece to pivot on an axis perpendicular to the sides of the watch assembly between a closed position in contact with said backing and an open position and a second part of the locking device for cooperating with said first part of the locking device for locking said timepiece in the closed position, said locking device having a release member for releasing said first part from the second part of said locking device to enable said timepiece to pivot on said hinge apparatus;

a panel extending across said opening in said backing proximate the place of contact of said timepiece with said backing; and a removable door extending across said opening in said backing distal from the place of contact of said timepiece with said backing for creating a secret compartment between said panel and said cover.

* * * * *